United States Patent [19]

Trachte

[11] Patent Number: 4,566,635

[45] Date of Patent: Jan. 28, 1986

[54] FUEL INJECTION NOZZLE FOR INTERNAL COMBUSTION ENGINES

[75] Inventor: Dietrich Trachte, Leonberg, Fed. Rep. of Germany

[73] Assignee: Robert Bosch GmbH, Stuttgart, Fed. Rep. of Germany

[21] Appl. No.: 600,044

[22] Filed: Apr. 13, 1984

[30] Foreign Application Priority Data

Aug. 10, 1983 [DE] Fed. Rep. of Germany ..... 3328824
Dec. 8, 1983 [DE] Fed. Rep. of Germany ..... 3344396

[51] Int. Cl.[4] ..... F02M 47/02

[52] U.S. Cl. ..... 239/533.8; 239/533.3; 239/533.9; 137/506; 137/869

[58] Field of Search ..... 239/90, 533.3–533.12, 239/574, 584, 88, 89, 91, 92, 5; 137/506, 861, 869, 885

[56] References Cited

U.S. PATENT DOCUMENTS 2,558,148 6/1951 Nicolls ..... 239/584
3,817,456 6/1974 Schlappkohl ..... 239/533.5
3,997,117 12/1976 Kohler et al. ..... 239/533.8
4,186,884 2/1980 Mowbray ..... 239/533.8
4,258,883 3/1981 Hofmann et al. ..... 239/533.5 X
4,402,456 9/1983 Schneider ..... 239/90
4,448,356 5/1984 Nakajima et al. ..... 239/533.5

FOREIGN PATENT DOCUMENTS 2301744 7/1973 Fed. Rep. of Germany ... 239/533.3

*Primary Examiner*—Andres Kashnikow
*Assistant Examiner*—James R. Moon, Jr.
*Attorney, Agent, or Firm*—Edwin E. Greigg

[57] ABSTRACT

A fuel injection nozzle for internal combustion engines, having a valve needle, which at the end of a pre-stroke directly or indirectly opens an auxiliary conduit, by way of which the fuel pressure acts upon a reservoir piston and a pressure shoulder which acts in the closing direction of the valve needle. As a result, the valve needle is temporarily returned to the valve seat and the closing pressure is notably increased. The subsequent primary injection phase is initiated at a correspondingly higher pressure, and the higher closing pressure continues effective until the end of the injection event, thereby bringing about an exact closure of the valve.

10 Claims, 4 Drawing Figures

FUEL INJECTION NOZZLE FOR INTERNAL COMBUSTION ENGINES

BACKGROUND OF THE INVENTION

The invention is based on a fuel injection nozzle as generally defined hereinafter. In injection nozzles of this type, in order to terminate the pre-injection phase a certain volume of the delivered fuel is "swallowed" by the deflecting reservoir piston, so that the valve needle is temporarily braked or even, depending on the design, returned to the valve seat. Furthermore the effective pressure area on the valve needle is reduced in size by the size of the second pressure shoulder, so that to move the valve needle further or to reopen the valve a notably higher fuel pressure is required, and the primary quantity of the fuel is then injected at this higher pressure. The reduced effective pressure area is maintained until the end of the injection event, thereby producing an exact end of injection with a high closing pressure.

In a known injection nozzle of this type (U.S. Pat. No. 2,558,148), the reservoir piston is displaceably disposed in a cylindrical bore in the interior of the valve needle. The mouth of the auxiliary fuel conduit is located at one end of the cylindrical bore, which forms the second pressure shoulder of the valve needle. The reservoir piston has a valve tang extension of offset diameter, which is pressed by the restoring spring against the mouth of the auxiliary conduit and monitors the mouth. At the end of the pre-injection phase the auxiliary conduit is opened in accordance with the fuel pressure, which is extended in a virtually unthrottled manner into the auxiliary conduit and there acts upon the valve face of the valve tang extension on the reservoir piston. As soon as the latter has uncovered the mouth of the auxiliary conduit, the fuel pressure in the cylindrical bore acts upon the entire cross-sectional surface area of the reservoir piston and rapidly translates the latter into its terminal position, in which it is supported on the housing and where it remains until approximately the end of injection. Initiating the primary injection phase in accordance with pressure has the disadvantage that if the opening pressures of the valve needle and deflecting piston are varied, it becomes possible for the deflecting piston to open without a pre-injection having taken place beforehand.

OBJECT AND SUMMARY OF THE INVENTION

The apparatus according to the invention has the advantage over the prior art that the primary injection phase is initiated in accordance with the length of the stroke executed by the valve needle, whereby it is assured that the provisions for reducing the effective pressure area and for "swallowing" a portion of the delivered fuel are not initiated until the valve needle has uncovered a cross section for the pre-injection—that is, until the preinjection has in fact already taken place.

A simple structural design is attained when the reservoir piston is displaceably supported in a cylindrical bore of the nozzle housing, coaxially with the valve needle, and is pressed during the pre-injection phase against the second pressure shoulder of the valve needle and is movable with the valve needle, and itself controls the auxiliary fuel conduit discharging from the side into the cylindrical bore. With this disposition, the valve needle itself does not need to have its own means for controlling the auxiliary fuel conduit.

In injection nozzles having a nozzle body which supports an inwardly opening valve needle and is firmly clamped to a nozzle holder which contains a closing spring chamber, the nozzle body and the valve needle used may be of a conventional design, if the cylindrical bore receiving the reservoir piston is embodied in the nozzle holder and discharges into the closing spring chamber, and if the valve needle acts via a tappet upon the reservoir piston, which extends on into the cylindrical bore and there bears a piston extension sealing the mouth of the cylindrical bore into the closing spring chamber.

An injection nozzle that is no longer than conventional designs, or only slightly longer, can be realized if the reservoir piston is embodied as an annular body and is supported in an annular chamber formed between the wall of the cylindrical bore in the nozzle body in which the valve needle is guided and a valve needle section of reduced diameter and is defined on one end by the annular shoulder, acting as the second pressure shoulder, at the transition to the offset valve needle section.

Another constructive way to attain a stroke-dependent control is afforded in accordance with the invention in that the reservoir piston is movably supported in a cylindrical bore in the valve needle, and that the auxiliary fuel conduit leads via a transverse bore in the valve needle that discharges into the cylindrical bore.

In a further development of the invention it is proposed that the means for opening up the auxiliary conduit be coupled via a stroke-converting fuel cushion with the valve needle. It is thereby attained that the covering of the auxiliary conduit in the closing position of the valve needle can be dimensioned larger than the valve needle stroke, approximately in proportion with the stroke translation by the fuel cushion; as a result, the tightness of the covering is increased. The speed with which the auxiliary conduit is opened is also increased accordingly by this provision.

A simple realization is attained if the fuel cushion is enclosed in a cylindrical bore of stepped diameter, the wider bore section of which guides a piston firmly connected with the valve needle and the narrower bore section of which is defined by the control piston. It is then advantageously possible for the cylindrical bore receiving the fuel cushion to serve as a reservoir chamber, and the control piston itself may embody a reservoir piston.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
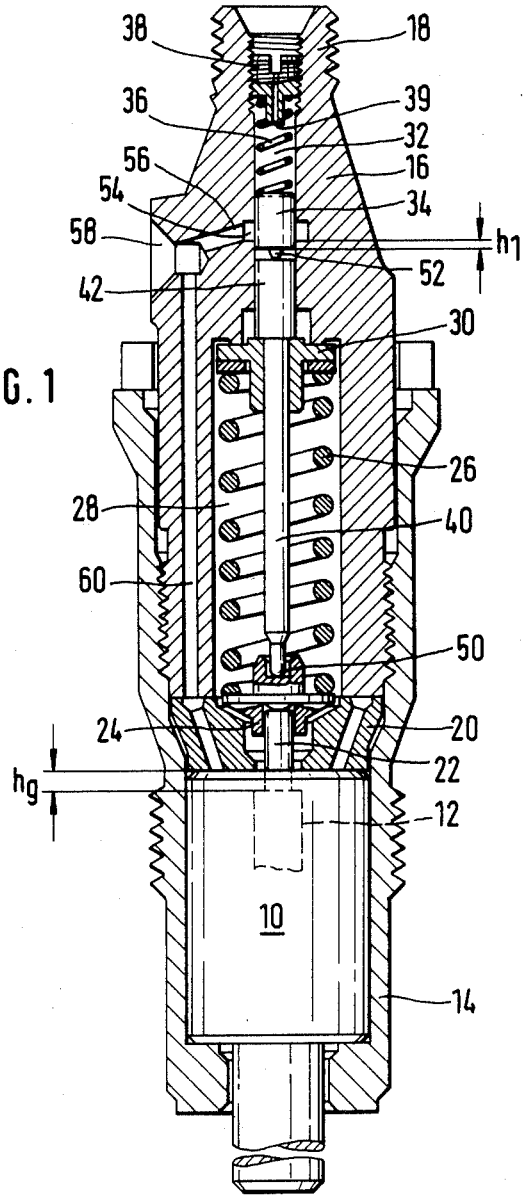
FIG. 1 shows the first exemplary embodiment of the invention, partly in longitudinal section and partly in a side view.

The injection nozzle shown in FIG. 1 has a nozzle body 10, in which a valve needle 12 that is only suggested in the drawing is displaceably supported. The nozzle body 10 is shown only in a side view, because the particular embodiment of the actual nozzle area, with the injection ports, is of only lesser importance in the present context. The nozzle body 10 is fastened via a sleeve nut 14 to a nozzle holder 16, which at the upper end face has a threaded fitting 18 for connecting an oil leakage line.

Fastened between the nozzle body 10 and the nozzle holder 16 is an intermediate disc 20 which defines the opening stroke of the valve needle 12. To this end, the valve needle 12 has an annular shoulder at the transition to a needle section 22 of reduced diameter, and at the end of the opening stroke this annular shoulder comes to rest on the lower end face of the intermediate disc 20. A pressure piece 24 is placed upon the needle section 22 and is engaged by a closing spring 26, which is disposed in a closing spring chamber 28 in the nozzle holder 16. The closing spring 26 is supported via a spring support plate 30 on the bottom of the closing spring chamber 28.

A cylindrical bore 32 for a reservoir piston 34 is provided in the nozzle holder 16, coaxially with the closing spring chamber 28. This cylindrical bore 32 begins at the threaded fitting 18 and discharges into the closing spring chamber 28. The reservoir piston 34 is acted upon by a reservoir spring 36, which is supported on a threaded part 38 secured in an outer threaded section of the cylindrical bore 32 and contains a central bore 39 for carrying away leaking oil. A stem 40 is disposed inside the closing spring 26, and with a piston-like extension 42 it protrudes sealingly into the cylindrical bore 32. An annular shoulder is formed at the transition to the extension 42, and in the illustrated position of the stem 40 it rests on the top of the spring plate 30. The lower end 50 of the stem 40 extends as far as a central shoulder face of the pressure piece 24.

The reservoir piston 34 is provided, on its end face oriented toward the stem 40, with a protrusion 52, which assures a free interspace between the reservoir piston 34 and the piston-like extension 42 of the stem 40. In the illustrated closing position of the valve needle 12, the reservoir spring 36 presses the reservoir piston 34 against the extension 42 of the stem 40. In this position, the reservoir piston 34 overlaps an annular groove 54, which communicates via an auxiliary conduit 56 with a connection fitting 58 for a fuel supply line, by a short stroke dimension $h_1$. From the connection fitting 58, a main conduit 60 leads into a pressure chamber in the nozzle body 10, in which in a known manner the valve needle 12 has a first pressure shoulder, and which communicates with the injection ports via a valve seat monitored by the valve needle 12.

The injection nozzle shown functions as follows:

At the onset of an injection event, the delivered fuel acts only upon the first pressure shoulder of the valve needle 12, this pressure shoulder being located in the nozzle holder 10; as a result, the valve needle 12 is displaced. At the same time, via the stem 40, the valve needle 12 displaces the reservoir piston 34 upward by the stroke dimension $h_1$, so that the reservoir piston 34 opens the annular groove 54. From this instant on, fuel travels via the auxiliary conduit 56 into the area of the cylindrical bore 32 located between the reservoir piston 34 and the extension 42. The reservoir piston 34 deflects upward, and in so doing "swallows" a certain amount of the delivered fuel, so that the fuel pressure drops temporarily. At the same time the fuel pressure exerts a closing pressure upon the end face of the extension 42. As a result, the valve needle 12 is returned rapidly to the valve seat. By that time, a pre-injection quantity of the fuel has emerged from the injection nozzle, at a moderate pre-injection pressure.

As a result of the action of the fuel pressure upon the end face of the piston-like extension 42, the effective surface area engaged by the fuel and acting in the opening direction is reduced by the cross-sectional area of the extension 42, so that the valve needle 12 is not lifted up from the valve seat until the fuel pressure has increased to a notably higher level. Subsequently, in a second phase of the injection event, the primary quantity of the fuel is injected at the higher pressure. The higher opening or closing pressure is now maintained, independently of the needle stroke, until the injection event has ended completely, thereby resulting in a sharply defined end of injection with rapid needle closure.

Figure 2:
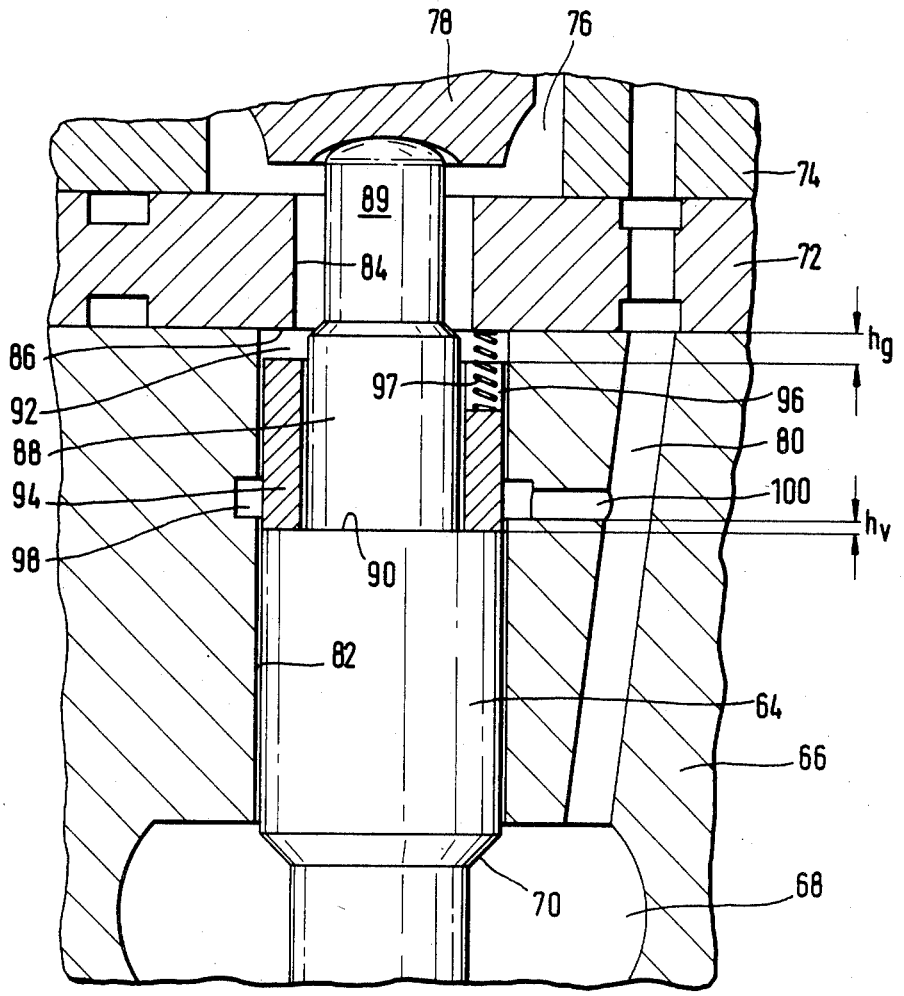
FIGS. 2–4 show a fragmentary longitudinal section taken through the second, third and fourth exemplary embodiments, respectively.

The injection nozzle according to FIG. 2 has a valve needle 64, which is displaceably supported in a nozzle body 66 and has a pressure shoulder 70 in the area of a pressure chamber 68. The nozzle body 66 and an intermediate disc 72 are fastened to a nozzle holder 74 with the aid of a threaded nut, not shown. In this nozzle holder, a chamber 76 for a closing spring is provided in the conventional manner, the closing spring acting via a pressure piece 78 upon the valve needle 64. The pressure chamber 68 communicates via a main conduit 80, formed by bores and annular grooves in the various individual housing parts, with a fuel connection fitting on the nozzle holder 74.

A cylindrical bore 82 is provided in the nozzle body 66, and the valve needle 64 is axially guided in this cylindrical bore 82 with a slight play, which is shown on an enlarged scale in the drawing. The intermediate disc 72 has a central through bore 84, the diameter of which is smaller than that of the cylindrical bore 82, so that an annular shoulder 86 is created in the plane of division between the parts 66 and 72. The valve needle 64 has a segment 88 of reduced diameter, which extends inside the cylindrical bore 82 and merges with an end tang 89, which passes through the through bore 84 and carries the pressure piece 78. At the transition to the segment 88, a second pressure shoulder 90 is formed on the valve needle 64, pointing in the opposite direction from the first pressure shoulder 70; the surface area of this second pressure shoulder 90 is smaller than the total surface area, acting in the opening direction, on the valve needle that is engaged by the fuel on the valve needle 64.

An annular chamber 92 is formed between the section 88 of the valve needle 64 and the wall of the cylindrical bore 82; in the axial direction it is defined by the annular shoulder 86 integral with the housing and by the pressure shoulder 90 on the valve needle 64. A reservoir piston 94 embodied as an annular body is placed upon the segment 88; it has only a slight radial play with respect to both the extension 88 and the wall of the cylindrical bore 82, and it is shorter by the total stroke $h_g$ of the valve needle 64 than the annular chamber 92, when the valve needle 64 is in the closing position. The reservoir piston 94 is provided on its upper rim with three recesses 96 distributed uniformly over the circumference and intended for receiving helical springs 97, which are supported on the annular shoulder 86 and press the reservoir piston 94 against the pressure shoulder 90 of the valve needle 64.

An annular groove 98 which is connected via an auxiliary conduit 100 to the main conduit 80 is provided in the cylindrical bore 82. The lower flank of the annular groove 98 is offset by the length $h_v$ of a preinjection stroke with respect to the pressure shoulder 90, whenever the valve needle 64 is located in the closing position. The chamber 76 in the nozzle holder 74 is provided in a known manner with a leakage oil connection.

Once the valve needle 64 has executed the prestroke $h_v$, the pressure shoulder 90 reaches the vicinity of the annular groove 98. From this instant on, the fuel pressure is exerted via the auxiliary conduit 100 into the gap between the annular piston 94 and the pressure shoulder 90 and guides the reservoir piston 94 upward, until it strikes the intermediate disc 72. The reservoir piston 94 thereby "swallows" a certain volume of the fuel and simultaneously the fuel pressure exerts a closing force upon the pressure shoulder 90, so that the valve needle 64 closes again. As a result of the exertion of the fuel pressure upon the pressure shoulder 90, the surface area of the pressure shoulder 90 engaged by the fuel in the opening direction decreases in size. The fuel pressure must now, as in the foregoing exemplary embodiment, rise to a notably higher level before the valve needle 64 again rises from the valve seat and is translated into its fully open position, in which it is supported via the reservoir piston 94 on the intermediate disc 72. The higher closing pressure is then maintained until the valve needle has returned to its closing position.

Figure 3:
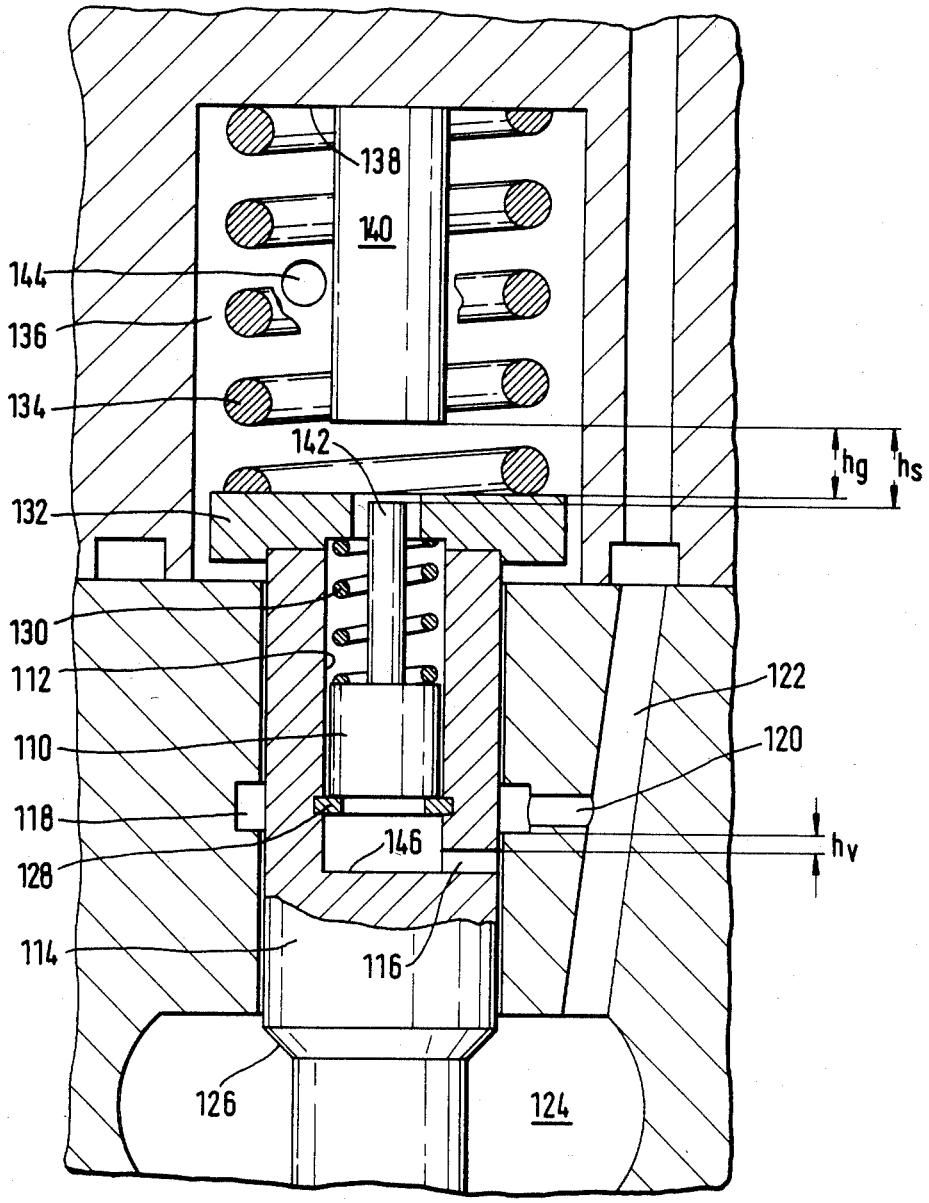

The injection nozzle according to FIG. 3 has a reservoir piston 110, which is guided with slight play in a cylindrical bore 112 of a valve needle 114. A transverse bore 116 discharges into the cylindrical bore 112, and in the closing position of the valve needle 114 the upper edge of the transverse bore is remote by the length of a pre-stroke $h_v$ from the lower flank of an annular groove 118, which communicates via an auxiliary conduit 120 with a main conduit 122. The latter leads into a pressure chamber 124, inside which the valve needle 114 has a first pressure shoulder 126.

An annular shoulder 128 is formed in the cylindrical bore 112, and the reservoir piston 110 is pressed by a helical spring 130 against it. The helical spring is supported on a plate 132, which is firmly connected to the valve needle 114 and acts as the pressure piece for a closing spring 134, which acts upon the valve needle 114 in the closing direction. The closing spring 134 is disposed in a chamber 136, and supported on the bottom 138 thereof. A stop means 140 is also secured to the bottom 138, and together with the plate 132 the stop means 140 limits the valve needle stroke to the dimension $h_g$. A tang 142 is formed on the reservoir piston 110, and together with the stop means 140 this tang 142 limits the total stroke of the reservoir piston 110 to the dimension $h_s$. The chamber 136 communicates with a leakage oil line 144.

Once the valve needle 114 has traversed the prestroke $h_v$, the transverse bores 116 and the annular groove 118 are arranged to overlap one another, so that the fuel pressure also builds up in the cylindrical bore 112 below the reservoir piston 110 and guides the reservoir piston upward until it strikes the stop means 140. In so doing the reservoir piston 110 "swallows" a certain fuel volume, so that the fuel pressure acts on the bottom face 146 of the cylindrical bore 112 and the valve needle 114 is returned back to its valve seat. Once the fuel pressure has subsequently risen to a correspondingly higher level, the valve needle is displaced back in the opening direction, until the plate 132, after the entire stroke $h_g$ has been executed, strikes the stop bolt 140. The increased closing pressure is then maintained until the complete closure of the valve needle.

The reservoir piston 110, returning to its initial position shown under the influence of the helical spring 130, positively displaces the previously "swallowed" fuel volume into the main conduit 122 as soon as the transverse bore 116 and the annular groove 118 overlap one another. The fuel volume that may at that time still remain to be positively displaced can then subsequently travel via the radial play between the reservoir piston 110 and the wall of the cylindrical bore 112, as well as via the chamber 136, and from there can reach the leakage oil line 144.

Figure 4:
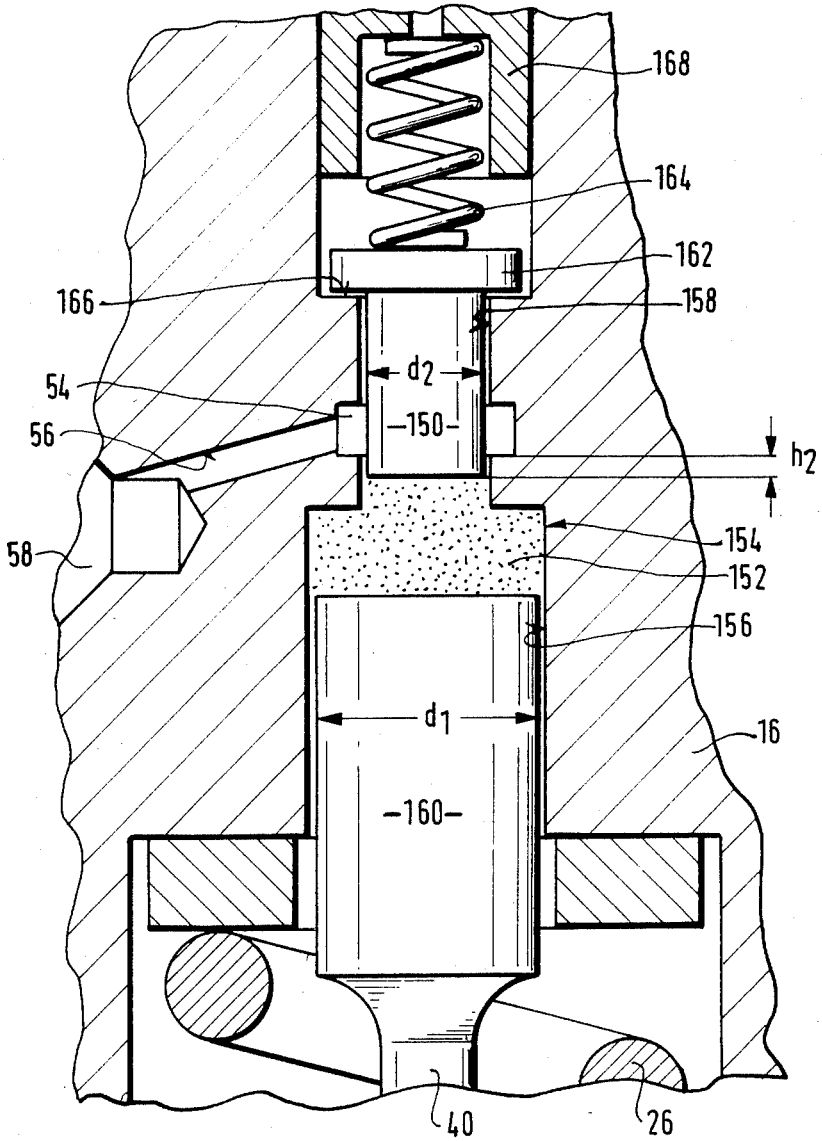

The injection nozzle of FIG. 4 agrees in principle with that of FIG. 1. What is different here is that the means for opening the auxiliary conduit 56, namely a reservoir piston 150, is coupled with the valve needle via a stroke-converting fuel cushion 152. The fuel cushion 152 is enclosed in a cylindrical bore 154, which has two bore sections 156, 158 of different diameters. A piston 160 is tightly guided in the larger bore section 156 and is mechanically coupled with the valve needle via the stem 40. In the narrower bore section 158 of the cylindrical bore 154, the reservoir piston 150 is tightly guided, having an annular collar 162 which in the closing position of the valve needle is pressed by a restoring spring 164 against a shoulder 166 integral with the housing.

The auxiliary conduit 56 discharges into an annular groove 54, as in the exemplary embodiment of FIG. 1; however here the annular groove 54 surrounds the narrower bore section 158 of the cylindrical bore 154, which simultaneously embodies the reservoir chamber. The reservoir piston 150 is dimensioned such that in the starting position shown it overlaps the annular groove 54 by the dimension $h_2$. The dimension $h_2$ may, or must, be dimensioned larger than the dimension $h_1$ of FIG. 1, because the reservoir piston 150 traverses a path that is longer by the ratio between the diameters of the pistons, $d_1/d_2$, than that traversed by the valve needle or the piston 160. As a result, there is improved tightness of the overlap of the auxiliary conduit 56 or the annular groove 54. Otherwise the processes take place as in the exemplary embodiment of FIG. 1. The stroke of the reservoir piston 150 is limited by an inserted bushing 168.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection nozzle for internal combustion engines having a nozzle housing and a valve needle pre-tensioned by a closing spring, said valve needle having a first pressure shoulder engaged continuously by fuel pressure in an opening direction of said valve needle and further having means for opening an auxiliary fuel conduit to allow said fuel pressure to act upon a spring-loaded reservoir piston and a second pressure shoulder of said valve needle upon termination of a pre-injection phase, said second pressure shoulder being arranged to point in an opposite direction from the first pressure shoulder, and said means for opening said auxiliary fuel conduit opens said conduit in accordance with a stroke of said valve needle.

2. A injection nozzle as defined by claim 1, wherein said reservoir piston is displaceably supported in a cylindrical bore of said nozzle housing coaxially with said valve needle and urged during said pre-injection phase against the second pressure shoulder which is movable with said valve needle and arranged to control said auxiliary fuel conduit which discharges into said cylindrical bore above said piston.

3. An injection nozzle as defined by claim 1, wherein said nozzle body supports an inwardly opening valve needle and is fastened to a nozzle holder which contains a closing spring chamber, characterized in that said cylindrical bore which is arranged to receive the reservoir piston is embodied in the nozzle holder and arranged to discharge into said closing spring chamber, and further that said valve needle acts via a stem upon said reservoir piston which extends into said cylindrical bore and said stem arranged to support a piston to seal said cylindrical bore means.

4. An injection nozzle as defined by claim 2, wherein said reservoir piston comprises an annular body supported in an annular chamber formed in a wall surrounding said cylindrical bore, said annular chamber being arranged to guide said valve needle and a segment thereof having a diameter different from said valve needle, said segment being defined on one end by an annular shoulder on said valve needle of enlarged diameter relative thereto, said annular shoulder serving as said second pressure shoulder.

5. An injection nozzle as defined by claim 4, having an intermediate disc limiting said valve stroke between the nozzle body and said nozzle holder, wherein said annular chamber is arranged to receive said reservoir piston, said reservoir piston further including oppositely disposed end faces and one of said faces is in proximity to said intermediate disc and said intermediate disc further having a plurality of recesses arranged to receive individual restoring springs which are supported on said intermediate disc.

6. An injection nozzle as defined by claim 1, further wherein said reservoir piston is moveably disposed in a cylindrical bore provided in said valve needle and said auxiliary fuel conduit communicates with said cylindrical bore via a transverse bore disposed in said valve needle.

7. An injection nozzle as defined by claim 1, wherein means for opening said auxiliary conduit are coupled with said valve needle via a stroke-converting fuel cushion.

8. An injection nozzle as defined by claim 7, wherein said fuel cushion is enclosed in a cylindrical bore of stepped diameter, the larger bore section of which guides a piston coupled with said valve needle and the narrower bore section of which is defined by a control piston arranged to monitor said auxiliary conduit.

9. An injection nozzle as defined by claim 8, wherein said control piston is urged toward the closing position of said valve needle by a restoring spring against a stop means integral with said housing.

10. An injection nozzle as defined by claim 9, whereinsaid cylindrical bore which receives said fuel cushion acts as a reservoir chamber and said control piston embodies a reservoir piston.

* * * * *